US005923697A

United States Patent [19]

Pavlicevic et al.

[11] Patent Number: 5,923,697

[45] Date of Patent: Jul. 13, 1999

[54] COOLING DEVICE FOR THE ROOF IN ELECTRIC ARC FURNACES

[75] Inventors: Milorad Pavlicevic, Udine; Peter Tishchenko, Donezk; Alfredo Poloni, Fogliano Di Redipuglia; Angelico Della Negra, Povoletto, all of Italy

[73] Assignee: Danieli & C. Officine Meccaniche SPA, Buttrio, Italy

[21] Appl. No.: 08/839,312

[22] Filed: Apr. 17, 1997

[30] Foreign Application Priority Data

Apr. 30, 1996 [IT] Italy ..... UD96A0065

[51] Int. Cl.[6] ..... F27D 1/02

[52] U.S. Cl. ..... 373/74; 373/73

[58] Field of Search ..... 373/73, 74, 60

[56] References Cited

U.S. PATENT DOCUMENTS

| | | | |
|---|---|---|---|
| 4,146,742 | 3/1979 | Longenecker | 373/74 |
| 4,197,422 | 4/1980 | Fuchs et al. | 373/74 |
| 5,289,495 | 2/1994 | Johnson | 373/74 |

FOREIGN PATENT DOCUMENTS

| | | |
|---|---|---|
| 085461 | 8/1983 | European Pat. Off. . |
| 140401 | 5/1985 | European Pat. Off. . |
| 2409471 | 6/1979 | France . |
| 732572 | 2/1943 | Germany . |
| 2032829 | 1/1972 | Germany . |
| 4223109 | 9/1993 | Germany . |

*Primary Examiner*—Tu B. Hoang
*Assistant Examiner*—Quang Van
*Attorney, Agent, or Firm*—Stevens, Davis, Miller & Mosher, L.L.P.

[57] ABSTRACT

Device to cool the roof (10) in electric arc furnaces, of the type comprising a plurality of contiguous panels (27) disposed to cover at least a substantial part of the inner circumferential periphery of the roof (10), each of the panels (27) consisting of at least one pipe (11) wherein cooling fluids circulate, the roof (10) having at least one central aperture (35) to insert, position and move the electrodes (28) and at least one peripheral aperture, or fourth hole (16) to vent the fumes from inside the furnace, each cooled panel (27) covering its own defined arc of the inner circumferential ring of the roof (10) and comprising a spiral-shaped cooling pipe (11), the coils (15) of the spiral lying on respective vertical planes disposed substantially radially with respect to the center of the roof (10), the coils (15) defining a first outer layer (17) and a second inner layer (18) of pipes (11), the first outer layer (17) and second inner layer (18) being separated by a hollow space (19) lying on a plane suitable to the conformation of the roof (10) of the furnace and which serves as an intake ring (19) to circulate the fumes and direct them from inside the furnace towards the discharge aperture (16).

18 Claims, 4 Drawing Sheets

COOLING DEVICE FOR THE ROOF IN ELECTRIC ARC FURNACES

FIELD OF THE INVENTION

This invention concerns a device to cool the roof of electric arc furnaces.

The cooling device according to the invention is applied in cooperation with the inner periphery of the roof in electric arc furnaces, whether they be fed with direct or alternating current, used in steel works to melt metals.

BACKGROUND OF INVENTION

Roofs used to cover electric arc furnaces so as to prevent heat being dispersed from inside the furnace, and to prevent the leakage of noxious fumes and waste, are known to the state of the art.

These roofs normally have a substantially central aperture to insert, position and move the electrodes and a peripheral aperture, called the fourth hole, used in cooperation with intake and discharge conduits in order to take in the fumes and volatile waste from inside the furnace and carry them to the processing and purifying means and thence to the stack.

Given the working conditions inside the furnace, and in particular the extremely high temperatures which develop inside the furnace, there is a known need to provide systems to cool the roof, normally in cooperation with the inner surface of the roof.

This cooling is usually carried out by means of tubes or conduits structured as panels wherein the cooling fluid circulates.

One example of such cooling panels is described in EP-A-0 140 401.

The function of these cooling panels is to prevent the roof from over-heating and therefore to protect it from wear and from damage, and thus extend its working life.

A problem which has to be faced when these cooling devices known to the state of the art are installed is the lack of homogeneity in the distribution of temperatures on the inner surface of the roof.

In fact it is well known that, during the operating cycle of the furnace, the temperature is much higher in the central part of the roof, near the electrodes, than at the periphery.

Moreover, the temperature of the roof near the outlet opening, or fourth hole, is much higher than the temperature developed at the opposite side, and increases progressively as it approaches the fourth hole because of the considerable flow of incandescent fumes towards this area.

The intake systems connected with this fourth hole also determine a concentrated intake on a limited part of the whole furnace, and consequently cause localized wear and damage.

Systems to cool the roof which are known to the state of the art are not always able to guarantee the optimum heat insulation and protection which can prevent localized wear in those parts of the furnace which are most subject to over-heating.

Moreover these known devices give a heat exchange coefficient, or removal of the heat flow, which is substantially uniform over the whole surface of the roof, with the result that over all the roof it is necessary to guarantee a heat exchange coefficient at least equal to that required in the hottest part of the furnace, that is to say, near the fourth hole.

Consequently, for a large part of the inner surface of the roof the cooling system is out of proportion, thus causing a great consumption of energy and an excessive quantity of cooling fluid being used, whereas the hottest areas always work at a very high temperature, with the risk of breakdowns and breakages in the cooling conduits.

State of the art conduits may be circular, conformed as a ring or as a spiral, or they may be radial from the centre of the roof towards the periphery or vice versa.

However, these conduits, even when they are structured as panels, in most cases are arranged substantially on a single horizontal plane cooperating with the inner part of the furnace. This solution does not allow, except to a very limited degree, insulating material such as waste to accumulate; and yet the accumulation of waste or other material could greatly assist the panels in their action of cooling and heat insulation.

Moreover, all those cooling systems described exercise a cooling action which is substantially uniform over all the surface of the roof, given the constant flow of cooling water circulating in the conduits.

The state of the art also covers jet-type cooling devices, which use jets of water cooperating with the outer surface of the roof, where the water is sprayed and runs on the outer surface and is collected in the peripheral area.

In this case it is possible to distribute the jets of water in such a way as to obtain a greater cooling in the hottest points, but then there is the problem that a greater flow of water is obtained in the outer peripheral area, where a lesser removal of heat is required.

A further problem which affects the working life of roofs cooled according to systems known to the state of the art, is that there are welds between the single elements of the cooling conduits.

These welds form critical points and create tensions along the conduit which cannot be completely eliminated even by such heat treatments as tempering.

These tensions, together with the particular conditions of high temperature to which the pipes are subjected, may cause the welds to break, with the resulting leakage of cooling water into the furnace.

Given the high pressure of the water circulating in the cooling conduits, the amount of water which in this case penetrates the furnace is very high, and as soon as it comes into contact with the molten metal it evaporates very quickly, with a consequent sudden rise in pressure which may cause an explosion.

Such a situation requires that the furnace be closed down immediately, with all the technical and economic problems that this entails, apart from the potential danger for the workers.

SUMMARY OF THE INVENTION

The present applicants have designed, tested and embodied this invention to overcome the shortcomings of the state of the art and to achieve further advantages.

The purpose of this invention is to provide a cooling device for the roof in electric arc furnaces which makes it possible to obtain an optimum heat insulation of the furnace and a better yield, with a resulting reduction in production costs and a much lower risk of localized wear and damage.

A further purpose of the invention is to provide a cooling device with a considerably lower risk of breaking than conventional devices, increasing the working life of the device and reducing the stoppages required for maintenance between one cycle and the next to carry out repairs, which stoppages require the furnace to be closed down.

Still another purpose of the invention is to ensure a homogeneous and uniform intake of the fumes over the whole furnace, thus avoiding problems deriving from a concentrated intake over a limited area, and reducing to a minimum any losses in density of the fumes as they travel towards the fourth hole.

The cooling device according to the invention comprises a system of adjacent and communicating panels, each of which consists of at least a spiral pipe, with the coils arranged on a substantially vertical plane, so as to define together a double layer of pipes, one outer and one inner.

These inner and outer layers are arranged on their respective planes and are separated by a hollow space inside which is created an annular circulation of the fumes taken in, the hollow space lying on a plane which is suitable to the conformation of the roof.

The coils of the spiral are arranged substantially in a radial direction in cooperation with the inner circumferential periphery of the roof.

Each double-layered panel covers a defined arc of the circumferential periphery, and the whole of the panels together form a structure which is suitable to the conformation of the upper section of the furnace.

According to one embodiment of the invention, each panel, formed by a single spiral-shaped pipe, is joined at the ends to the adjacent panel to form a continuous cooling conduit.

According to a variant, the joints between the ends of the pipes are welded at points outside the furnace, and thus are not subject to particular heat stress.

In this way a continuous tubular structure is obtained, without any welds at critical points, and therefore not subject to the previously described problems, possibly with a single inlet and a single outlet for the cooling water.

According to a variant, there are several inlets and outlets for the cooling water, so that if one panel breaks it does not compromise the cooling action over the whole inner surface of the roof.

To make this structure self-supporting, according to a variant, the spiral-shaped piping is reinforced with the appropriate support elements.

With the double-layered panels according to the invention, the waste suspended in the fumes attaches itself in an extremely short time (about two casting cycles) to the pipes, thus creating a continuous insulating covering at least of the first outer layer.

According to a variant, there are anchoring and gripping means on at least part of the tubes, which encourage the waste to attach itself to the tubes and thus to form the covering and protective layer.

The second, inner layer of the double-layered panels is also partly covered by the waste to form an insulating layer, but the continual flow of the fumes taken in by the hollow space between the two layers prevents the space between two contiguous coils from being completely closed up, thus guaranteeing the free intake of the fumes.

The density of the coils of the cooling pipe along the inner circumference of the roof can be varied at will, to obtain a greater or lesser coefficient of heat exchange, and therefore the greater or lesser cooling of a particular peripheral area of the roof according to necessity and also according to the conformation of the roof and of the furnace.

According to one embodiment of the invention, this density of the coils varies uniformly from a point of maximum coefficient to a point of minimum coefficient of heat exchange.

According to this embodiment, the point of maximum coefficient of heat exchange is placed in the area or in the proximity of the aperture, or fourth hole, of the fume intake conduit, and the point of minimum coefficient of heat exchange coincides with the coolest point of the roof, situated in a diametrically opposed position from the maximum point.

This differentiated distribution of the density of the coils allows a differentiated cooling of the roof, which gives a considerable improvement in the efficiency of the furnace.

Moreover, this differentiated distribution of the density of the coils makes it possible to correlate the entity of the cooling action to the greater or lesser temperatures which develop in the specific areas of the roof, which allows considerable energy savings to be made and, more in general, savings in the operational costs of the cooling device.

Moreover, with this embodiment, it is not necessary to over-develop the cooling action of the cooling device, and at the same time maintain a high level of safety and efficiency.

A further advantage of the differentiated distribution of the density of the coils, due to the presence of the fume intake ring in the space between the two layers of the inner and outer panels, is that the fumes are taken in evenly from the whole surface of the roof.

This is because the spaces between two contiguous coils in the second, inner panel, which allow the fumes to be taken in by the intake ring between the two layers of panels, are smaller in the area where depression is greater, in correspondence with or in proximity to the fourth hole, while they are bigger in the area where depression is smaller, thus achieving a substantial balance in the flow of fumes at every part of the roof.

To this end, according to a variant, the distance between the two layers of panels, or the size of section of the coil, may also vary from a point of maximum gas flow, which substantially coincides with the intake aperture, to a point of minimum gas flow, situated in a diametrically opposed position.

This variation in the distance between the two layers, outer and inner, causes a different flow to the fume intake ring, allowing a more uniform distribution of the fume intake over the surface of the roof.

A further advantage obtained by the radial disposition of the coils towards the centre of the roof is that the density of the cooling tubes, in the central part of the roof, is higher than that at the periphery, thus obtaining a more efficient cooling in the area adjacent to the electrodes, compared with the outer peripheral area.

Moreover, the presence of a double cooling panel makes it possible to have a decidedly better heat insulation than that which can be obtained with a traditional cooling system, with a considerable improvement in the yield of the furnace.

Since there are no welds at the critical points of the furnace, it is possible to avoid the problems described above which derive from the presence of welds; this extends considerably the working life of the furnace, and also considerably reduces the production costs and times.

According to a further variant, there is a double fume intake spiral which causes the fumes to be directed along a symmetrical route on the two halves of the inner circumference of the roof.

This solution gives an even more homogeneous intake, and further reduces the loss of waste from the fumes.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 1:
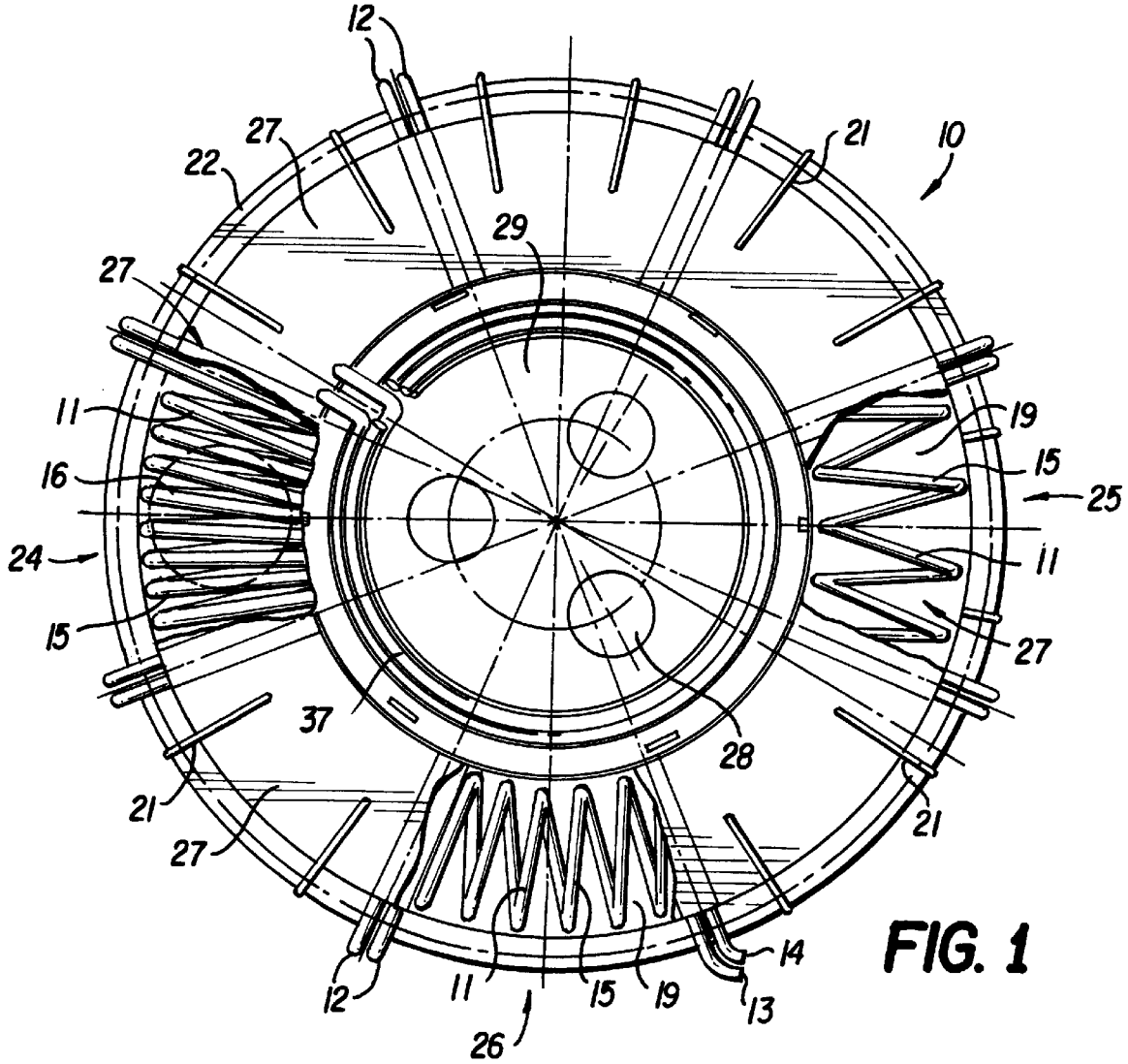
FIG. 1 shows a plane view, in a partial cross section, of a roof associated with a cooling device according to the invention.

The reference number 10 in the attached figures generally denotes. a cooled roof for electric arc furnaces in its entirety.

The roof 10 in this case is associated with a cooling device 30 comprising a plurality of contiguous panels 27 which together cover the whole inner circumferential periphery of the roof 10.

Each panel 27 consists in this case of a continuous pipe wound in a spiral whose individual coils 15, arranged adjacent on a substantially vertical plane, define a first outer layer 17 and a second inner layer 18 separated by a hollow space 19 lying on a substantially horizontal plane.

In this case, the pipes 11 of each individual panel 27 are joined to each other by their ends 12, to form a substantially continuous conduit with a single inlet 13 and a single outlet 14 for the cooling water.

According to a variant, each pipe 11 which constitutes the individual panel 27 has inlet and outlet interceptor means which intervene in the event of a breakage of the panel 27 and interrupt the flow of water.

In the embodiment shown, the density of the coils 15 formed by the pipe 11 varies progressively, along both the semi-circumferences of the roof 10, from an area 24 where the density is at its maximum, substantially coinciding with the aperture 16 for the exhaust fumes outlet, or fourth hole of the furnace, and an area 25 where the density is at its minimum, situated in a diametrically opposed position.

This differentiated distribution of the density of the coils 15 guarantees a greater and more intense cooling action where it is most needed, that is to say, where the temperatures are higher due to the flow of fumes towards the fourth hole 16.

In the intermediate areas 26 between the two areas 24 and 25, the density of the coils 15 is substantially an intermediate value between the minimum and maximum values.

The exhaust fumes coming from inside the furnace enter the hollow space 19 or intake ring through the apertures 20 in the adjacent coils of the second inner layer of panels 18.

Figure 4:
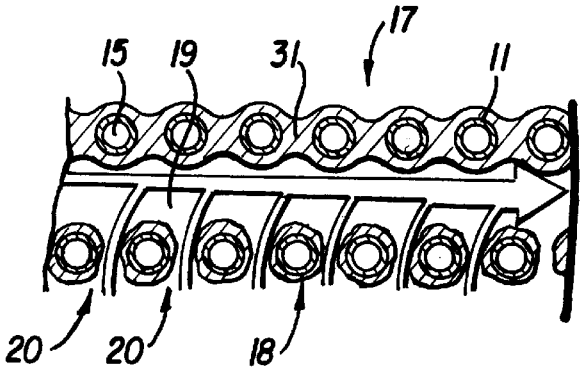
FIG. 4 shows a detail of the double layer of panels according to the invention.
Figure 2:
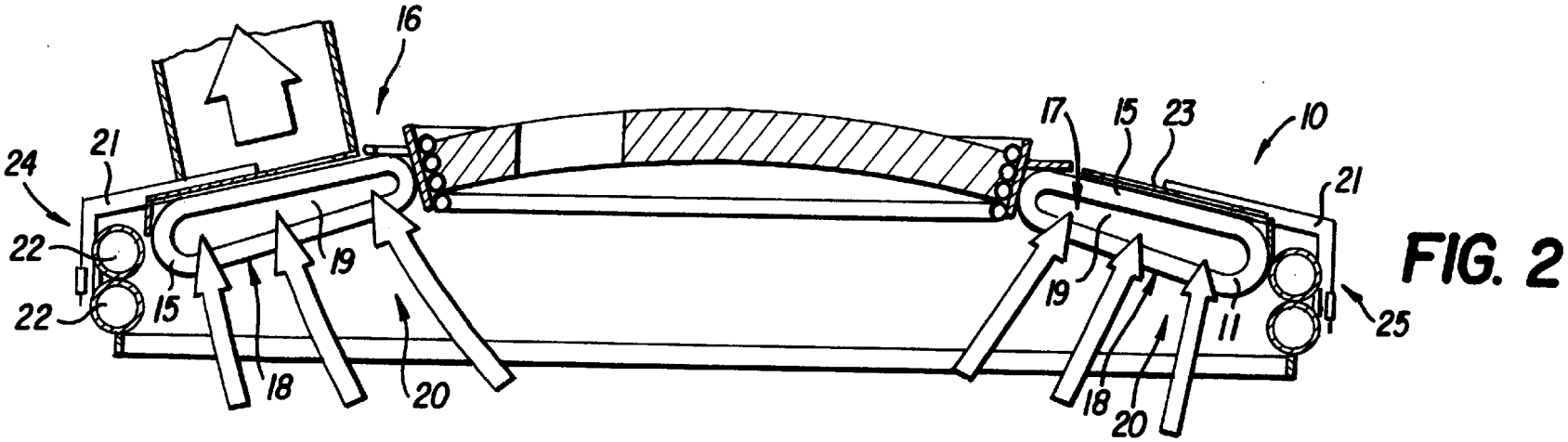
FIG. 2 shows a cross section from the side of the roof in FIG. 1.

In a short time, these exhaust fumes cause the formation of a covering layer of waste 31 which attaches itself to the pipes 11 until it completely seals the first outer layer 17 of panels 27 as shown in FIG. 4.

This lining of waste 31 attached to the pipes 11 considerably improves the insulation and heat protection of the furnace, reducing the thermal stress on the roof 10 of the furnace and therefore reduces wear and damage.

This waste also protects the pipes 11 from any overheating, which can lead to damage and breakages.

The second inner layer 18 of panels 27, on the contrary, is only partially covered by the waste, due to the continual flow of fumes through the apertures 20 which prevents the waste from forming a homogeneous, continuous layer.

The different size of the apertures 20, directly proportionate to the distance between two adjacent coils 15 and therefore to the density of distribution of the coils 15, allows the exhaust fumes to be taken in uniformly and homogeneously from inside the furnace.

In the area 24 situated near the intake aperture 16 or fourth hole, where the depression caused by the intake of fumes is at its maximum, the size of the aperture 20 is minimal, as the density of the contiguous coils 15 is at its maximum.

In the area 25 situated on the opposite side and therefore farthest from the intake aperture, where the depression is minimal, the size of the aperture 20 is at its maximum, since the density of the coils 15 is at its minimum.

This diverse arrangement of the coils 15 allows a substantially constant flow of fumes along every section of the hollow space or intake ring 19.

Moreover, this prevents problems from arising which are due to the concentrated intake of the fumes in a limited part of the whole furnace and to the different flow of fumes, which may cause the fumes to be delivered in a non-optimum manner.

Figure 3:
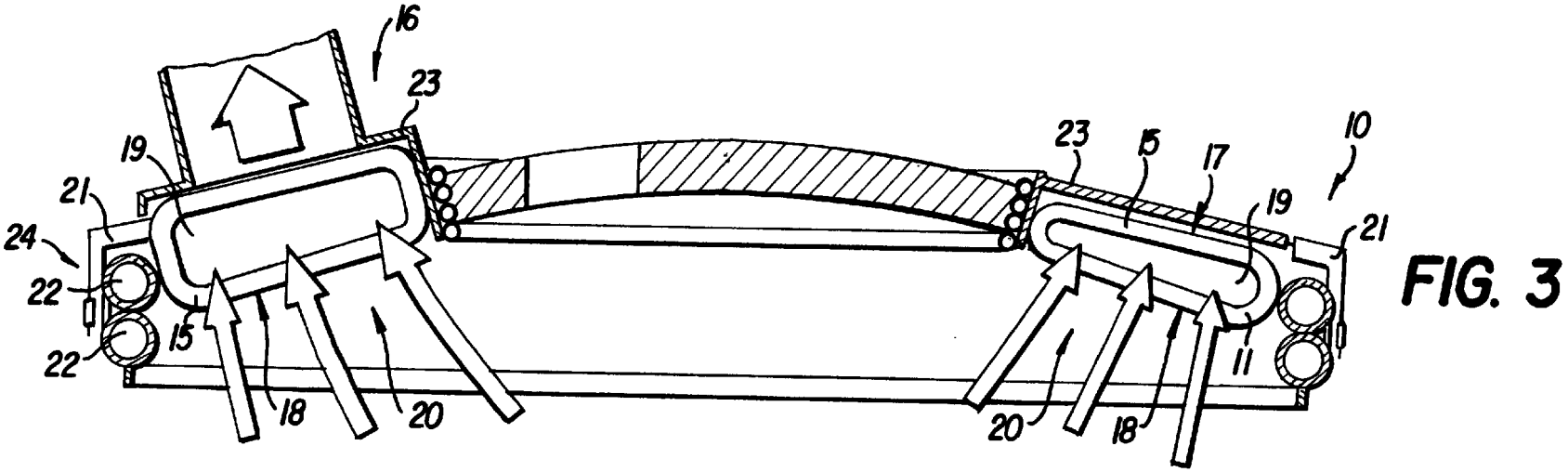
FIG. 3 shows a variant of FIG. 2.

According to a variant of the invention shown in FIG. 3, the section of the coils 15, or distance between the first outer layer 17 and the second inner layer 18, varies from the area 24 of maximum section, situated in correspondence with the aperture 16 of the intake conduit, where the flow of fumes is at its maximum, to the area 25 of minimum section, where the flow of fumes is at its minimum.

The differentiated cooling of the roof 10 and the even intake of exhaust fumes give a considerable improvement in the yield of the furnace, with an obvious reduction in the running costs both of the furnace and of the cooling device.

The very presence of the two layers of panels 27 outer 17 and inner 18, gives an improvement in the insulation and heat protection of the roof 10.

In the embodiments shown in the figures, the roof 10 comprises support elements 21 to make it self-supporting.

The support elements 21 cooperate in this case with two peripheral cooling rings 22 and with a covering lining 23.

In the central part of the roof, in correspondence with the electrodes 28, there is a cover 29 of the type known to the state of the art, peripherally cooled and having an aperture to position the electrodes 28.

Figure 5A:
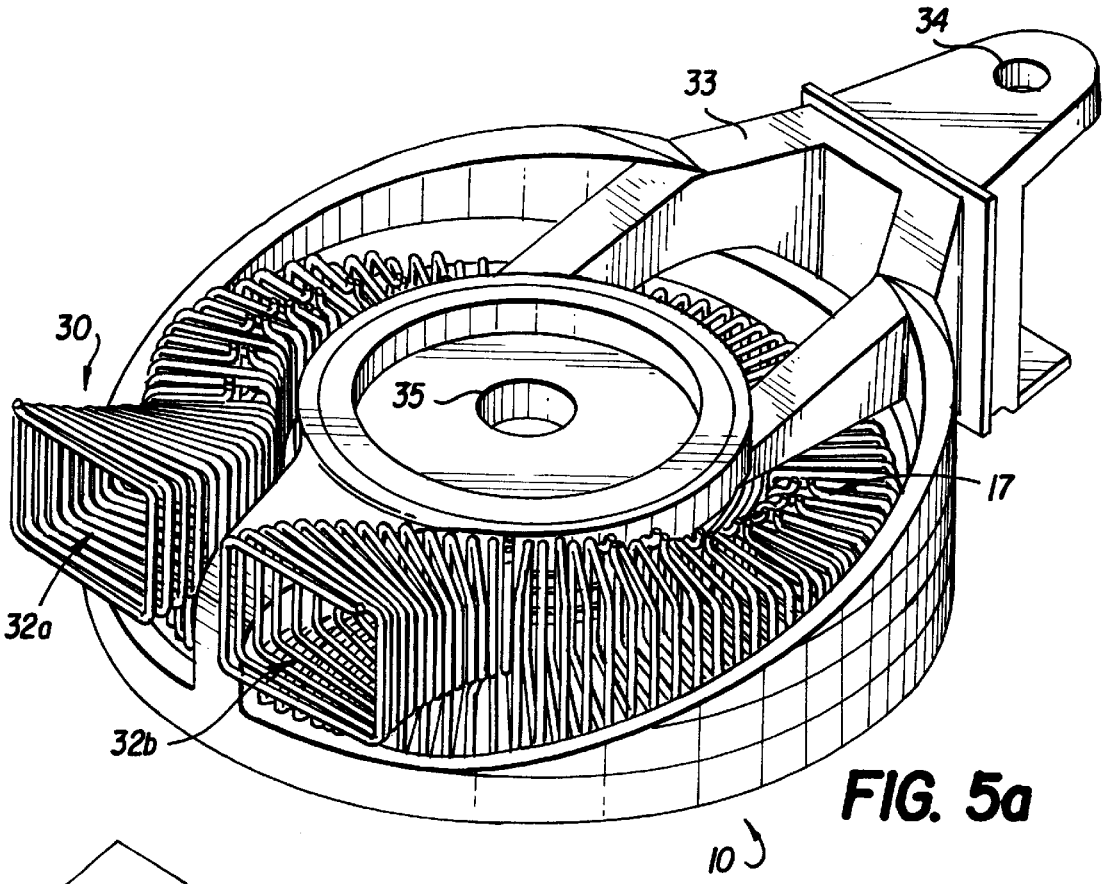
FIG. 5*a* and 5*b* show a perspective view from above and below of a roof associated with a double-spiral cooling device according to the invention and suitable for an AC furnace which includes a single upper electrode.
Figure 5B:
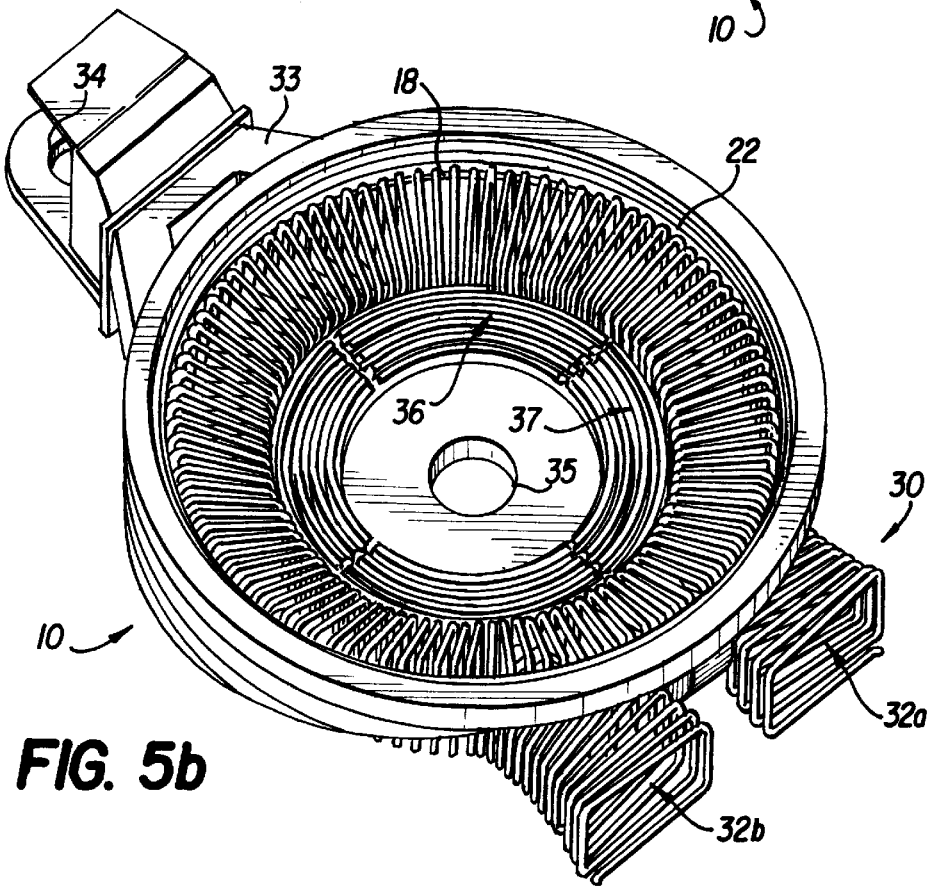
Figure 6:
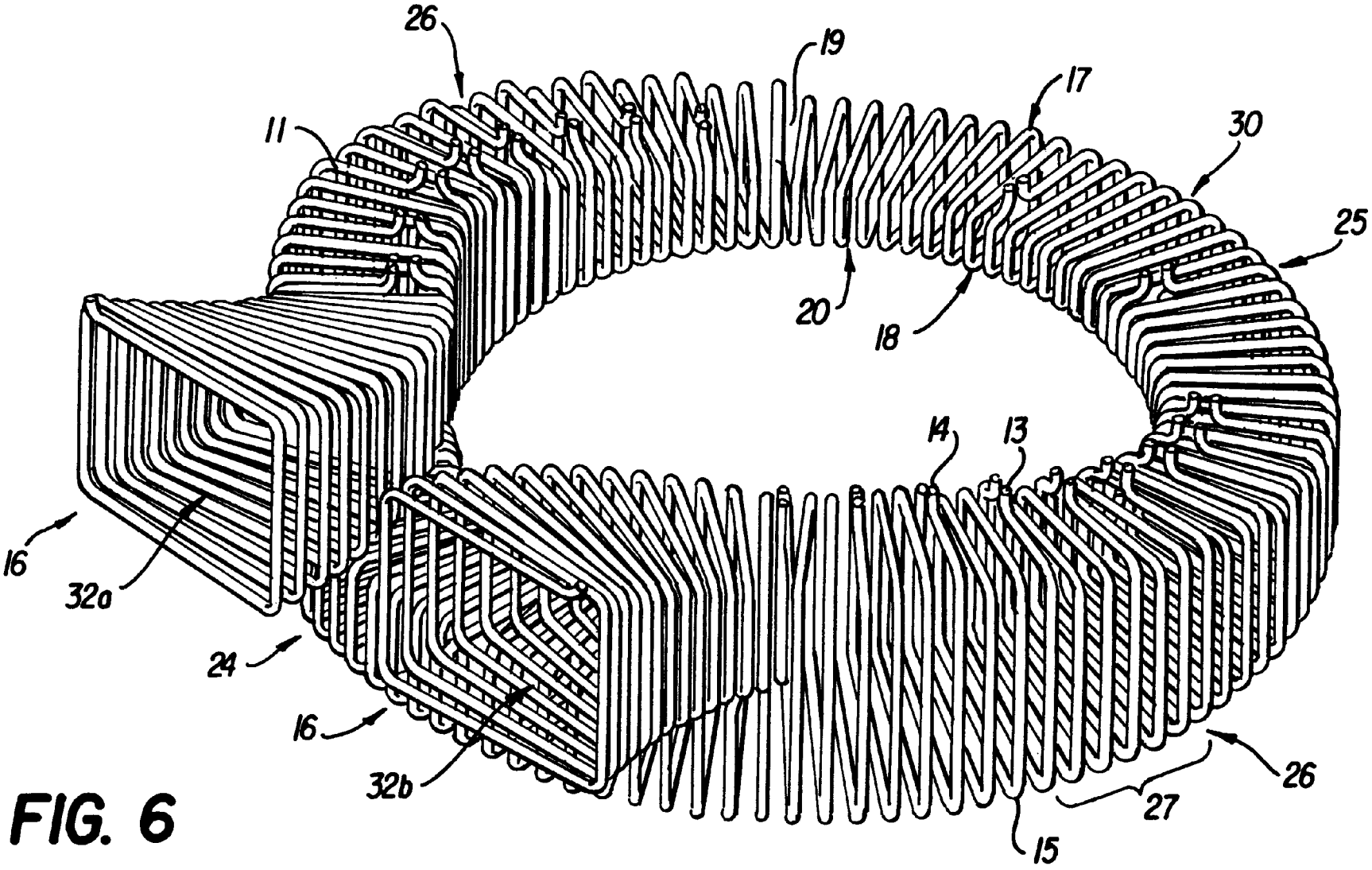
FIG. 6 show the cooling device of FIGS. 5*a* and 5*b*.

In the embodiment shown in FIGS. 5*a*, 5*b* and 6, the cooling device 30 has a double spiral conformation with two outlets, respectively 32*a* and 32*b*, connected to the intake aperture.

According to the invention there may also be a single outlet.

This double spiral conformation causes the fumes to follow a symmetrical route in the two semi-circumferences of the inner periphery of the roof 10, which ensures an even more uniform and homogeneous intake of the fumes along the intake ring 19 between the first outer layer 17 and second inner layer 18.

In the embodiment shown in FIG. 6 it can be seen how the density of the coils 15 and the section of the coils 15 can have a lesser value in the intermediate areas 26 between the area 24 of the fourth hole and the area 25 diametrically opposite, according to the particular technological and/or construction requirements of the furnace or of the roof 10.

In FIGS. 5*a* and 5*b* the device 30 is placed in a supporting structure 33 so as to constitute a movable roof for an electric furnace, of the type which rotates laterally on its axis 34.

Since the supporting structure 33 has a single hole 35 at its centre, it is obvious that it is for a DC furnace; this supporting structure 33 however can also have holes for the three electrodes needed for AC furnaces.

FIG. 5*b* shows the further cooling device 36 consisting of panels 37 wherein the cooling fluid circulates and arranged substantially coaxial and concentric to the aperture 35 through which the electrodes are inserted.

FIG. 5*a* shows how the supporting structure 33 cooperates with the cooling device 30.

We claim:

1. A device for cooling a roof (10) of an electric arc furnace, comprising a plurality of contiguous panels (27) disposed to cover at least a substantial part of the inner circumferential periphery of the roof (10), each of the panels (27) comprising at least a respective spiral shaped cooling pipe (11) to flow cooling fluid therethrough, the roof (10) having at least a central aperture (35) to insert, position and move the electrodes (28) and at least a peripheral outlet aperture (16) to vent fumes from inside the furnace, wherein each contiguous panel (27) covers its own defined arc of the inner circumferential periphery of the roof (10) and each spiral shaped cooling pipe (11) has coils (15) which form a spiral, the coils (15) lying on respective substantially vertical planes disposed substantially radially with respect to a vertical axis passing through the center of the roof (10), the coils (15) defining a first outer layer (17) and a second inner layer (18) of pipes (11), the first outer layer (17) and the second inner layer (18) being separated by a hollow space (19) and functioning as an intake ring to direct the fumes from the inside of the furnace towards the outlet aperture (16).

2. The cooling device as in claim 1, in which the spiral shaped pipe (11) of each panel (27) is composed of a single continuous pipe without welds.

3. The cooling device as in claim 1, in which the coils (15) of the spiral have a variable density along the circumference of the roof (10).

4. The cooling device as in claim 1, in which the coils (15) have a density which reaches its maximum in correspondence with the outlet aperture (16, 32) to vent the fumes.

5. The cooling device as in claim 1, in which the coils (15) have a density which is at its minimum in correspondence with the area farthest from the area where there is the outlet aperture (16, 32) to vent the fumes.

6. The cooling device as in claim 1, in which the hollow space (19) has a free section defined by the coils (15) which is variable in radial vertical cross-sectional area along the circumference of the roof (10).

7. The cooling device as in claim 6, in which the radial vertical cross-sectional area of the free section is at its maximum in correspondence with the outlet aperture (16) to vent the fumes.

8. The cooling device as in claim 1, in which each single spiral shaped pipe (11) of each respective panel (27) comprises its own inlet (13) for the cooling fluid and its own outlet (14) for the cooling fluid.

9. The cooling device as in claim 8, in which each individual panel (27) has its own interceptor means at least one member of the group consisting of the inlet for the cooling fluid and the outlet for the cooling fluid.

10. The cooling device as in claim 1, in which the spiral shaped pipes (11) of the individual panels (27) have ends, and the pipes are joined at their ends (12) along an outer periphery of the roof to form a substantially continuous pipe (11).

11. The cooling device as in claim 1, which includes peripheral cooling rings (22) arranged outside in cooperation with the panels (27).

12. The cooling device as in claim 1, which includes central cooling panels (37).

13. The cooling device as in claim 1, wherein said coils define paths for symmetrical circulation of the fumes.

14. The cooling device as in claim 1, where the outlet aperture to vent the fumes is an outlet hollow space (32) defined by a portion of the coils (15).

15. The cooling device as in claim 14, which includes two outlet apertures defined by respective portions of the coils.

16. The cooling device as in claim 1, wherein the hollow space lies on a plane substantially conforming to a shape of the roof.

17. The cooling device as in claim 1, wherein the hollow space lies on a substantially horizontal plane.

18. The cooling device as in claim 1, wherein the hollow space is substantially annular.

* * * * *